US006638084B2

(12) United States Patent
Mochizuki et al.

(10) Patent No.: US 6,638,084 B2
(45) Date of Patent: Oct. 28, 2003

(54) CONNECTOR SUPPORTING MECHANISM

(75) Inventors: Shinji Mochizuki, Shizuoka-ken (JP); Tetsuya Yamashita, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/080,592

(22) Filed: Feb. 25, 2002

(65) Prior Publication Data

US 2002/0119709 A1 Aug. 29, 2002

(30) Foreign Application Priority Data

Feb. 27, 2001 (JP) ..... 2001-052440

(51) Int. Cl.[7] ..... H01R 13/62
(52) U.S. Cl. ..... 439/157
(58) Field of Search ..... 439/152, 155, 439/157, 372

(56) References Cited

U.S. PATENT DOCUMENTS 5,888,081 A * 3/1999 Konoya et al. ..... 439/157
5,938,458 A * 8/1999 Krehbiel et al. ..... 439/157
5,971,779 A * 10/1999 Okabe ..... 439/157
6,183,282 B1 * 2/2001 Okabe ..... 439/310
6,419,507 B2 * 7/2002 Kurimoto ..... 439/157

FOREIGN PATENT DOCUMENTS

JP 11-40256 2/1999

* cited by examiner

*Primary Examiner*—Lynn Feild
*Assistant Examiner*—Thanh-Tam Le
(74) *Attorney, Agent, or Firm*—Finnegan, Henderson, Farabow, Garrett & Dunner, L.L.P.

(57) ABSTRACT

According to this invention, a lever plate 31 has a front contact portion 10 which comes into contact with a front face of a mounting object portion 36*c*, a front contact arm 36 having elasticity and rear contact protrusions 34,35 coming into contact with a rear face of the mounting object portion. Further, there is provided a centering tongue portion 36*b* which determines the center in the vertical direction of the connector main body 21 such that it presses an inner peripheral face of the mounting object hole 11 when a connector 20 is inserted into the mounting object hole 11.

8 Claims, 15 Drawing Sheets

PRIOR ART

CONNECTOR SUPPORTING MECHANISM

BACKGROUND OF THE INVENTION

1. Field of the Invention

The present invention relates to a connector supporting mechanism which engages female and male connectors with each other under a low insertion force by using a rotary lever, and more particularly to a connector supporting mechanism which allows to recognize visibly whether or not any one connector engages securely.

2. Description of the Related Art

For example, Japanese Patent Application Laid-Open No. 11-40256 has disclosed a connector supporting mechanism, which the inventor of the present invention considered. This connector supporting mechanism comprises auxiliary machine side connectors 101, 102 provided integrally on a rear face of an auxiliary machine, harness side connectors 103, 104 which are inserted into and coupled with these auxiliary machine side connectors 101, 102 and a connector holder 105, which holds the harness side connectors 103, 104. The connector holder 105 is mounted preliminarily on for example, an instrumental panel of a vehicle. This connector holder 105 intends to improve working efficiency for coupling the harness side connectors 103, 104 with the auxiliary machine side connectors 101, 102.

The connector holder 105 has flexible holding arms 108, 109, which engage engaging portions 106, 107 provided in upper and lower faces of each of the harness side connectors 103, 104. The connector holder 105 is provided with slide walls for guiding the auxiliary machine side connectors 101, 102 and the harness side connectors 103, 104. The auxiliary machine side connectors 101, 102 are different from each other in their protruding dimension. Therefore, the harness side connectors 103, 104 held by the connector holder 105 are fit to the auxiliary machine side connectors 101, 102 successively with a time interval. Therefore, a necessary insertion force can be smaller as compared to a case of fitting the plural connectors at the same time.

SUMARY OF THE INVENTION

However, the connector supporting mechanism shown in FIG. 1 has no means for recognizing whether or not the flexible engaging arms 108, 109 of the connector holder engages the engaging portions 106, 107 in the harness side connectors 103, 104 securely when the connector holder 105 is mounted on for example, an instrumental panel. For this reason, there is such a problem that disconnection of the harness side connectors 103, 104 from the connector holder 105 cannot be checked easily. Unless the harness side connectors 103, 104 are held in the connector holder 105 securely, such an insertion force (insertion distance) for fitting the auxiliary machine side connectors 101, 102 to the harness side connectors 103, 104 cannot be obtained, so that the auxiliary machine side connectors 101, 102 and the harness side connectors 103, 104 cannot be electrically connected with each other.

Further, in the related connector supporting mechanism shown in FIG. 1, the insertion force for fitting the auxiliary machine side connectors to the harness side connectors is reduced by differentiating the protruding dimensions to the auxiliary machine side connectors 101, 102. If the number of the harness side connectors increases, the structure of the auxiliary machine side connector becomes multiple steps, so that a maximum protruding length of the auxiliary machine side connector is prolonged. Meanwhile, although it is considered that the insertion force for fitting to the auxiliary machine side connectors is reduced by gathering a number of terminals on the harness side connector and providing the harness side connector with a lever which exerts an action of a lever, a means for recognizing whether or not the harness side connector is held in the instrumental panel securely is necessary in this case also.

Accordingly, an object of the present invention is to provide a connector supporting mechanism capable of recognizing whether or not the connectors are fit securely so as to achieve a secure connection.

To achieve the above object, according to a first aspect of the present invention, there is provided a connector supporting mechanism for supporting a connector in which an engagement lever comprised of a pair of lever plates disposed on both sides of a connector main body and a linking portion which links these integrally mounted lever plates is on a connector main body rotatably such that it is kept inserted into a mounting object hole formed in a sheet-like mounting object portion, each of the lever plates including a front contact portion which comes into contact with a front face of the mounting object portion, a front contact arm having elasticity and a rear contact portion which comes into contact with a rear face of the mounting object portion. Further, this lever plate has a hole contact portion which determines the center in the vertical direction of the connector main body such that it makes contact with an inner peripheral face of the mounting object hole with a pressure when the connector is inserted into the mounting object hole, this hole contact portion being provided at a front end of the contact arm.

According to the first aspect, the mounting object portion is nipped by the front contact portion and the rear contact portion formed on each of a pair of the lever plates disposed across the connector main body, so that the connector main body can be installed temporarily in the mounting object hole in the mounting object portion. Further, because the hole contact portions provided on the front ends of the contact arms come into contact with the upper and lower edge portions of the mounting object hole with elasticity, the center in the vertical direction of the connector main body is determined with respect to the mounting object hole. Consequently, the connector can be supported appropriately. Thus, the centering work does not have to be done when installing the connector onto the mounting object portion, thereby improving the installation efficiency.

According to a second aspect of the present invention, the front contact portion has a thickness allowing itself to be seen from the front of the mounting object portion and the hole contact portion and the front contact portion are formed with a step.

Therefore, according to the second aspect, because the front contact portion is formed thickly, when the hole contact portion with a step relative to this front contact portion comes into contact with the edge of the mounting object portion, visibility of the front contact portion when viewing the connector from the front of the mounting object portion is improved. Thus, it can be recognized easily that the connector is installed temporarily in the mounting object portion. Further, because the connector is supported securely by the mounting object portion, this connector can be coupled with other connector securely.

Further, according to a third aspect of the present invention, a distance between the hole contact portions formed on the contact arms of the pair of the lever plates is longer than a vertical dimension of the mounting object hole.

According to the third aspect, as well as the first and second aspects, the hole contact portions comes into contact with the upper and lower edge portions of the mounting object hole. Therefore, the accuracy of centering in the vertical direction of the connector is improved.

Further, according to a fourth aspect of the present invention, the front contact arm is inclined such that it leaves the lever plate gradually.

Therefore, according to the fourth aspect, as well as the first to third aspects, the front contact arm is inclined such that it leaves the lever plate gradually. Therefore, by seeing that inclined face, it is possible to recognize that the front contact arm has passed the mounting object hole and expanded again (due to elastic force) so that the hole contact portion comes into contact with the upper and lower edge portions of the mounting object hole, thereby the connector being installed securely temporarily.

DESCRIPTION OF THE PREFERRED EMBODIMENTS

Hereinafter, the preferred embodiments of the connector supporting structure of the present invention will be described in detail with reference to the accompanying drawings.

Figure 1:
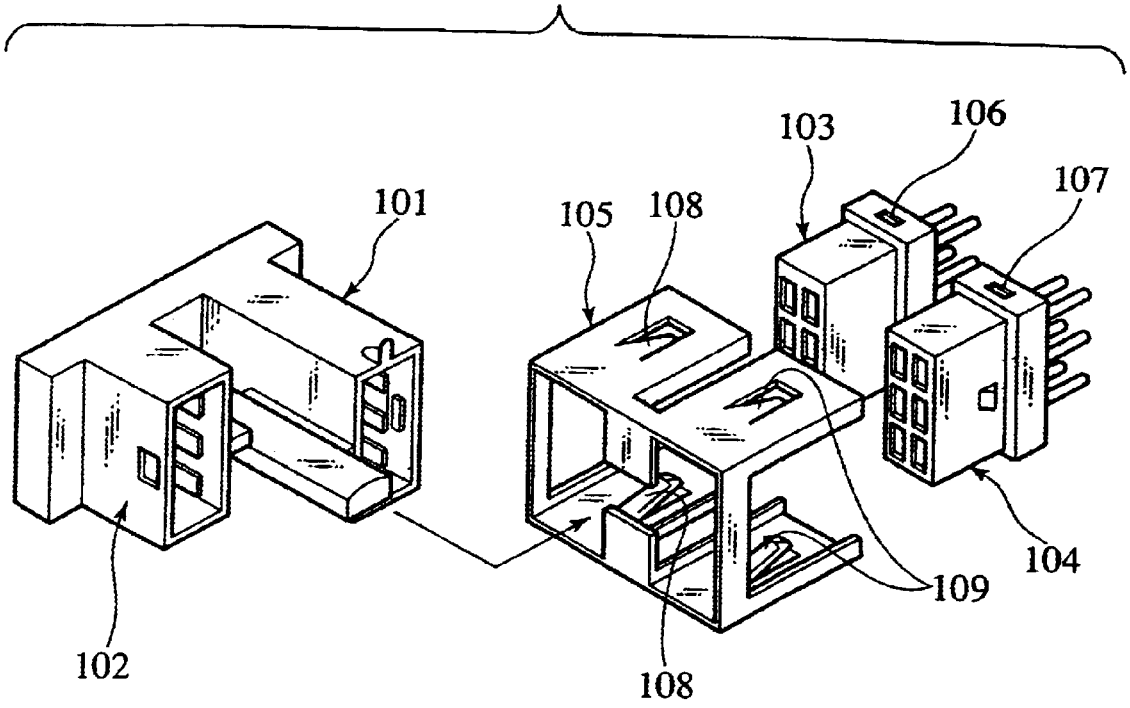
FIG. 1 is a disassembly perspective view showing a related connector supporting mechanism.
Figure 2:
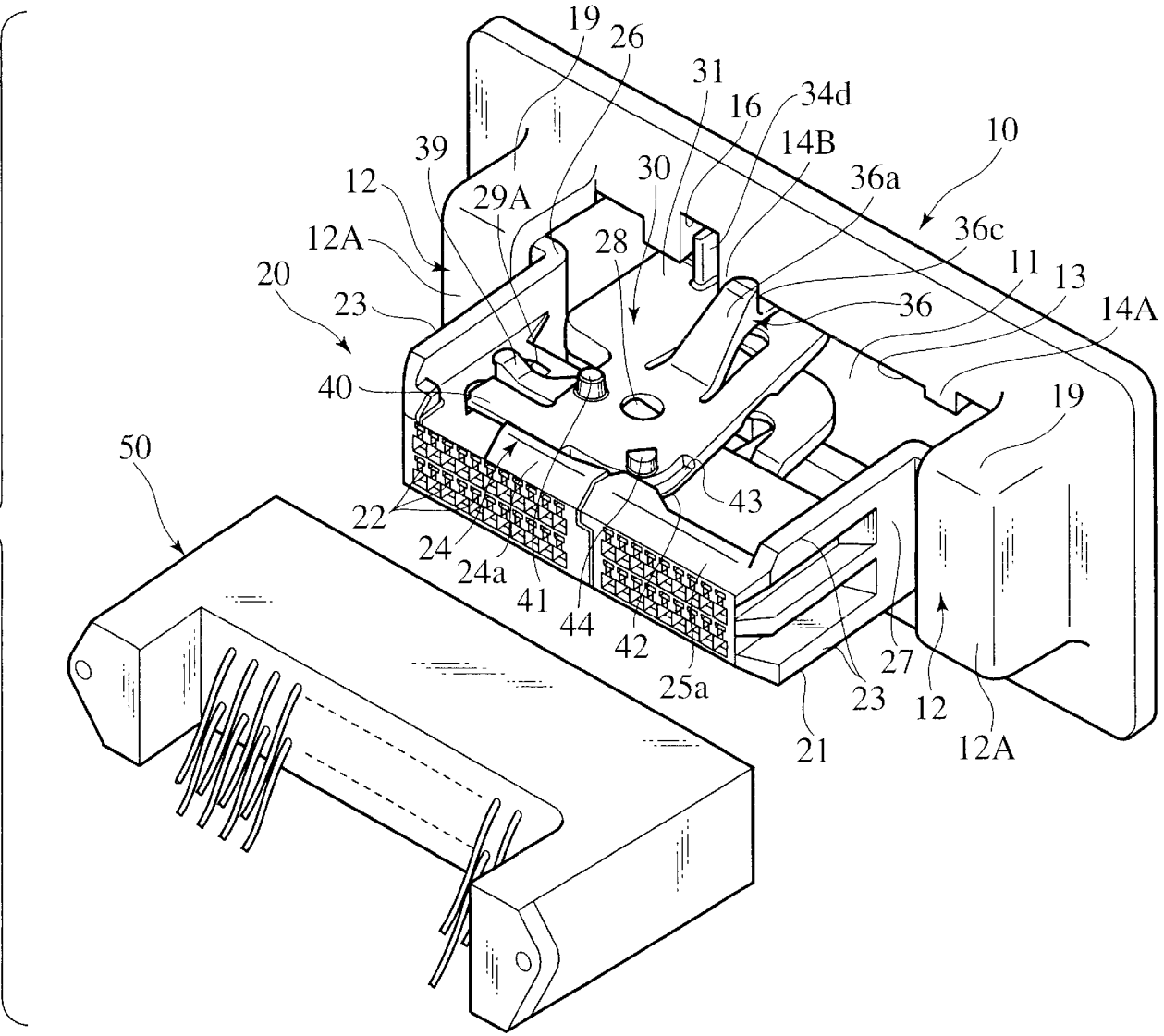
FIG. 2 is a perspective view showing an embodiment of the connector supporting mechanism of the present invention.
Figure 3:
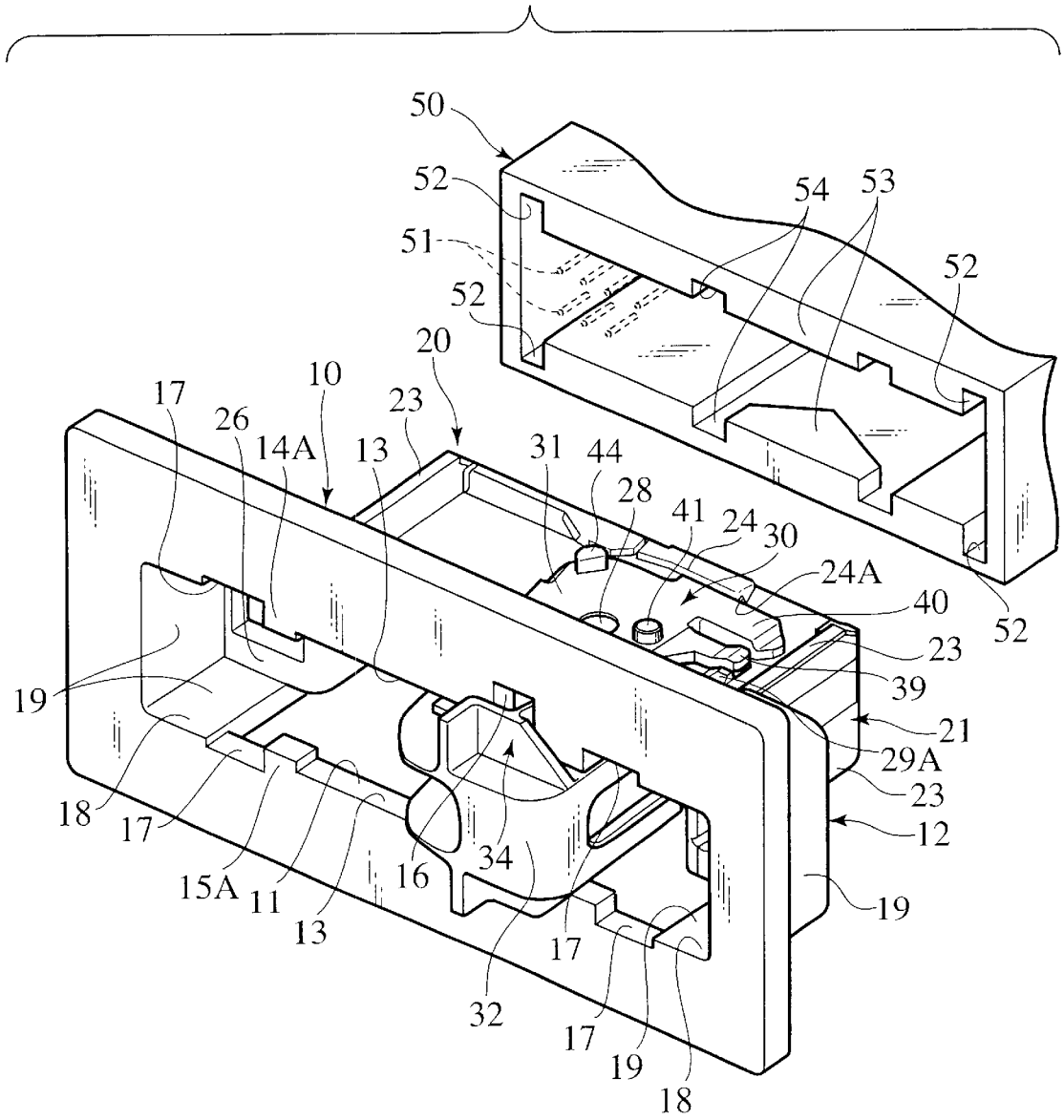
FIG. 3 is a perspective view showing a condition in which the connector supporting mechanism of the embodiment is viewed from obliquely backward.

FIGS. 2 to 23 show the embodiments of the connector supporting mechanism of the present invention. The connector supporting mechanism of this embodiment substantially comprises a mounting object portion 10, which is an instrumental panel provided on a stay member side of, for example, a vehicle, a first connector 20 which is to be mounted to this mounting object portion 10, and a second connector 50 which is to be coupled with this first connector 20, as shown in FIGS. 2, 3.

(Structure of the mounting object portion)

Figure 4:
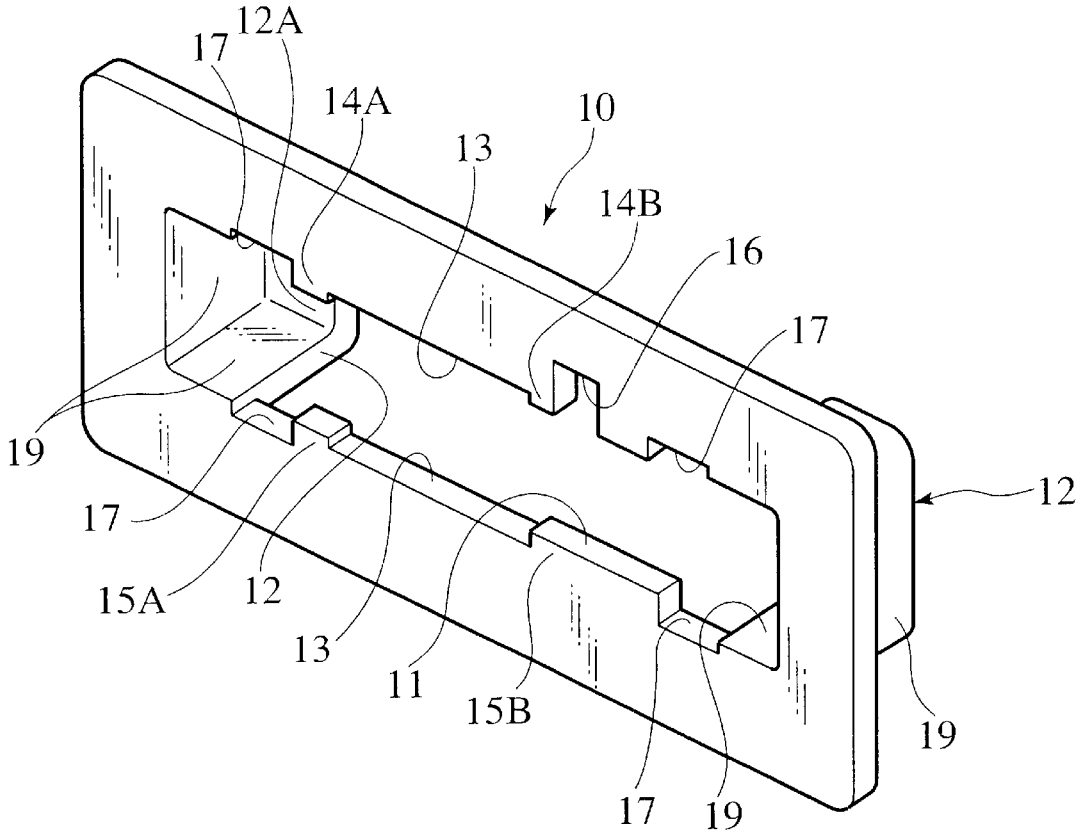
FIG. 4 is a perspective view showing a condition in which a mounting portion for use in the connector supporting mechanism of the embodiment is viewed from its rear side.
Figure 5:
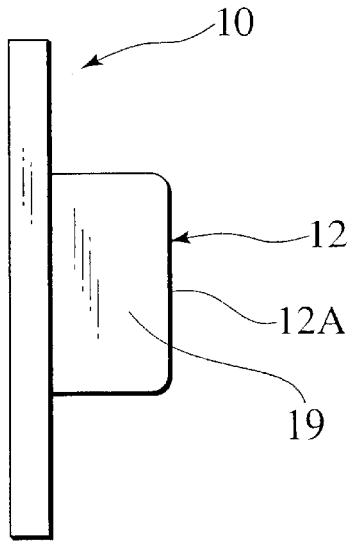
FIG. 5 is a side view of the mounting portion for use in the connector supporting mechanism of the embodiment.
Figure 6:
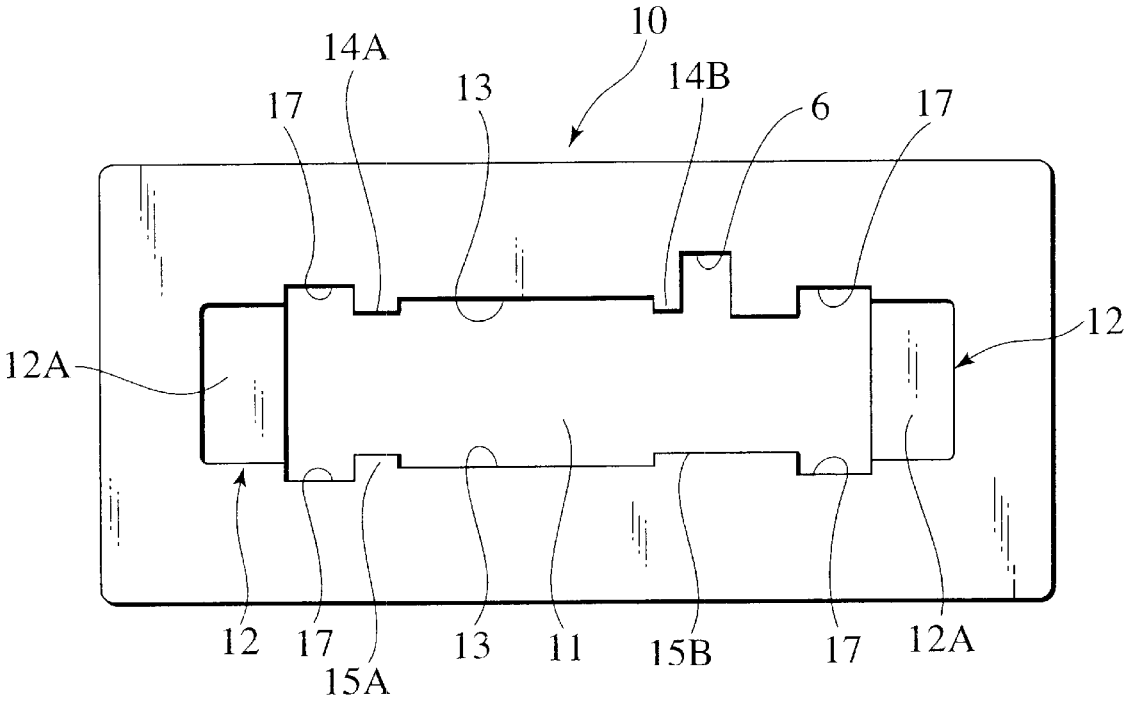
FIG. 6 is a rear view of the mounting portion for use in the connector supporting mechanism of the embodiment.
Figure 7:
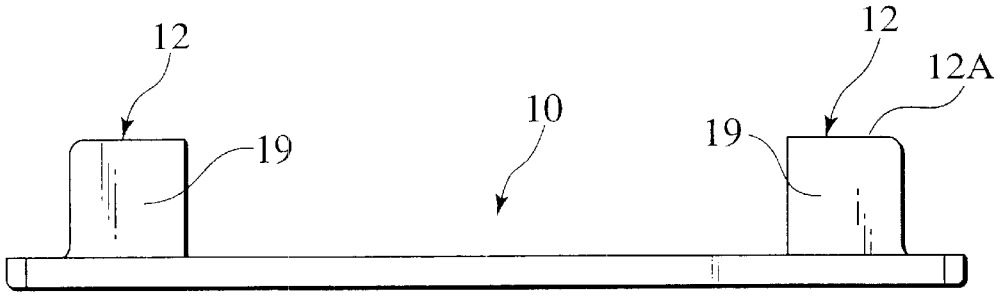
FIG. 7 is a plan view of the mounting portion for use in the connector supporting mechanism of the embodiment.

First, the structure of the mounting object portion 10 will be described with reference to FIGS. 2 to 7. FIG. 2 is a perspective view of the mounting object portion 10 as viewed from the front side thereof. FIGS. 3, 4 are perspective views of the mounting object portion as viewed from the rear side thereof. FIG. 5 is a side view of the mounting object portion 10, FIG. 6 is a rear view of the mounting object portion 10 and FIG. 7 is a plan view of the mounting object portion. Although this embodiment is so constructed that the mounting object portion 10 prepared separately is fixed to the stay member of the vehicle, the mounting object member 10 may be formed integrally with the stay member.

The mounting object portion 10 has a substantially rectangular mounting object hole 11 and contact step portions 12, 12 formed on both the right and left sides of the mounting object hole 11 such that they are expanded forward. As shown in FIGS. 4, 6, a lever rotation concave portion 13 which allows a rotation of the engagement lever 30 mounted on a first connector 20, which will be described later, is formed in the center of each of upper and lower edges of the mounting object hole 11 as shown in FIGS. 4, 6. A distance between bottom sides of the lever rotation concave portions 13 formed in the upper and lower edges of the mounting object hole 11 is set up longer than the thickness of the first connector 20 only by a predetermined dimension. On both sides of the lever rotation concave portion 13 on the upper edge of the mounting object hole 11 are formed rotation restricting step portions 14A, 14B for restricting a rotation of the engagement lever 30. Additionally, on both sides of the lever rotation concave portion 13 in the lower edge of the mounting object hole 11 are formed rotation restricting step portions 15A, 15B for restricting a rotation of the engagement lever 30. A coupling error preventing concave portion 16 is formed in the middle of the rotation restricting step portion 14B. A coupling error preventing rib 34*b* of the engagement lever 30 of the first connector 20 can be inserted into this coupling error preventing concave portion 16 only when it is installed normally. A guide concave portion 17, in which a guide protruded portion 23 of the first connector 20 is to be inserted, is formed outside in the width direction of each of the rotation restricting step portions 14A, 14B. That is, the guide concave portions 17, which make a pair so that they oppose each other vertically, are formed in the upper and lower edges of the mounting object hole 11.

The contact step portion 12 is comprised of side walls 19 extended from an opening edge 18 consisting of three sides such that it is substantially U shaped, of the mounting object hole 11 located outside in the width direction of the guide concave portion 17 and a rectangular contact plate 12A formed substantially parallel to a panel surface of the mounting object portion 10 such that it is stretched over a region formed with front end edges of the three side walls 19 extended from the three sides. Meanwhile, an contact leg portion 26 of the first connector 20 comes into contact with a rear face of this contact plate 12A.

(Structure of the first connector 20)

Figure 8:
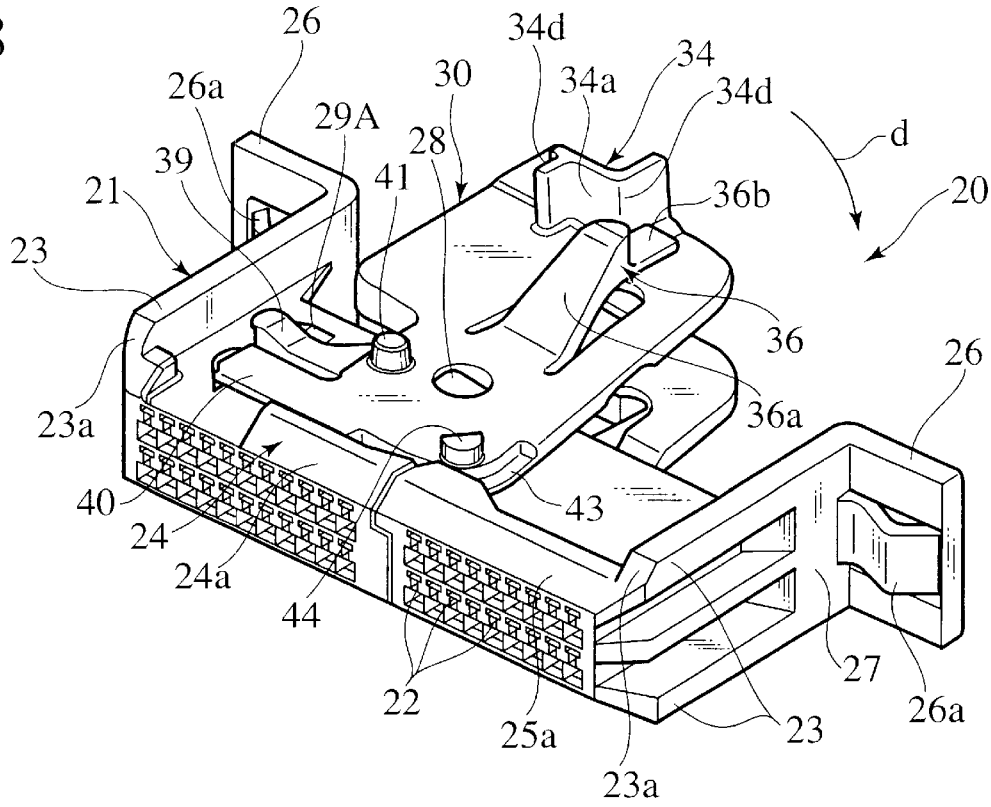
FIG. 8 is a perspective view showing a first connector of the embodiment.

Next, the structure of the first connector 20 will be described with reference to FIGS. 2, 3 and 8 to 19. As shown in FIG. 8, the first connector 20 is comprised of a substantially rectangular parallelepiped first connector main body 21 and an engagement lever 30 supported in a manner that is rotatable by upper and lower faces of the first connector main body 21 as shown in FIG. 8. The first connector main body 21 and the engagement lever 30 are formed of synthetic resin.

FIGS. 9 to 13 show a condition in which the engagement lever 30 is not mounted on the first connector main body 21. This first connector 20 is inserted into the mounting object hole 10 from the rear side of the mounting object hole 11 and engages with this hole as described later.

As shown in FIGS. 2, 8, 9 and 11, the first connector main body 21 includes a plurality of terminal accommodating chambers 22 formed in the back/forth direction. Each terminal accommodating chamber 22 contains a female terminal metal (not shown). This female terminal metal is coupled with a male terminal metal 51 of a second connector 50 so that electric connection is achieved.

On both side portions in the width direction of upper and lower faces of the first connector main body 21 are formed the guide protruded portions 23, which are guided into the second connector 50 along the back and forth direction. The guide protruded portions 23 formed on the upper face of the first connector main body 21 are protruded upward while the guide protruded portions 23 formed on the lower face of the first connector main body 21 are protruded downward.

Figure 12:
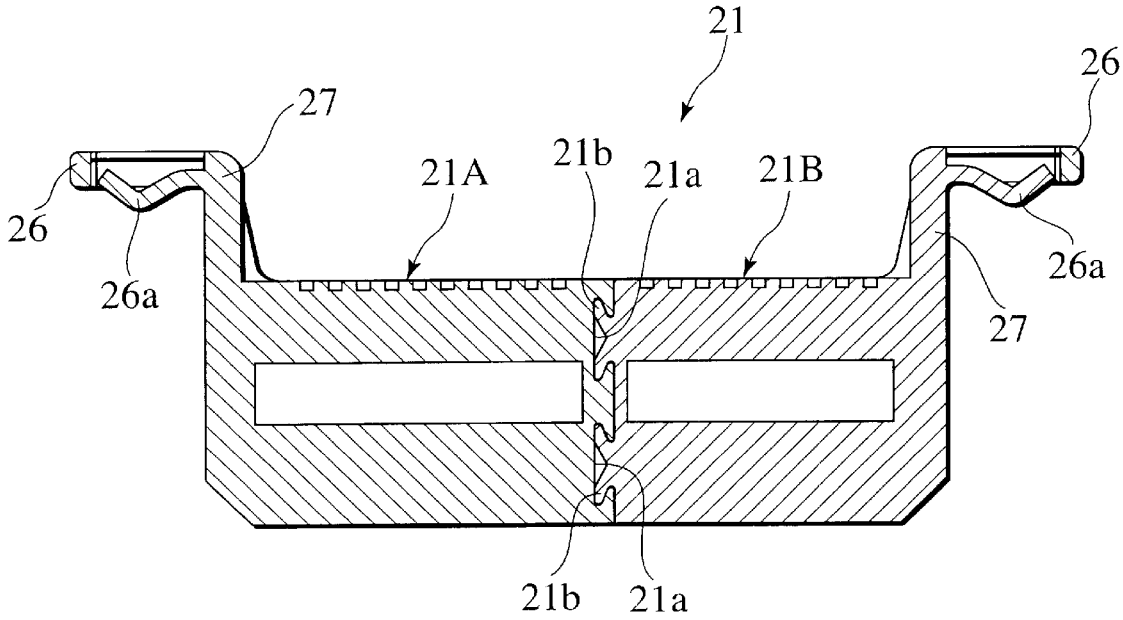
FIG. 12 is a sectional view taken along the lines XII—XII of FIG. 11.

According to the present embodiment, the first connector main body 21 is composed of right and left separate connector units 21A,21B as shown in FIGS. 9 to 12. These connector units 21A, 21B are coupled with each other by coupling a coupling object portion 21*a* with a coupling portion 21*b* formed on respective adjacent side portions as shown in FIG. 12. FIG. 12 is a sectional view taken along the lines XII—XII of FIG. 11.

According to this embodiment, a front end portion in the coupling direction of each of the upper and lower faces of the connector unit 21A has a guide tapered face 24*a* for guiding the first connector 20 into the second connector 50. Further, a stopper 24 for restricting an inversion of the engagement lever 30 is provided protrudedly on each of the upper and lower faces. A guide concave portion 24*a*, into which a peripheral step portion 43 formed on the engagement lever 30 is to be inserted, is formed in a rear face of the stopper 24 along the width direction of the stopper 24.

Figure 13:
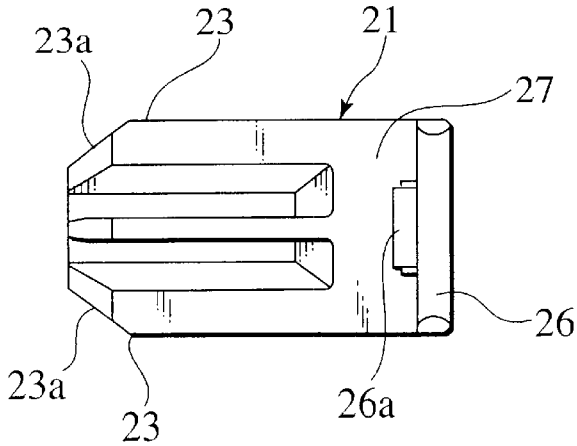
FIG. 13 is a side view of the first connector of the embodiment.

A front end portion in the coupling direction of each of the upper and lower faces of the other connector unit 21B has a guide protruded portion 25 having a guide tapered face 25*a* like the aforementioned stopper 24. As shown in FIG. 13, a guide tapered face 23*a* is formed on a front end portion of the aforementioned guide protruded portion 23 like the guide tapered faces 24*a*, 25*a*. Although according to this embodiment, the first connector main body 21 is composed by coupling the two connector units 21A,21B, it is needless to say that the first connector main body 21 may be formed integrally.

On both sides on the rear side in the coupling direction (outside of a rear end portion of each of the connector units 21A, 21B) of the first connector main body 21 are provided contact leg portions 26 such that they are protruded sideways. This contact leg portion 26 is a substantially rectangular plate piece, in which an engagement contact portion 26*a* is formed in the center such that it is expanded forward in the coupling direction. This engagement contact portion 26*a* is formed integrally with the contact leg portion 26. This engagement contact portion 26*a* is formed on a side edge on the proximal portion of the contact leg portion integrally with this contact leg portion 26 and the other peripheral edges (three sides) are separated from this contact leg portion 26. Because this engagement contact portion 26*a* is expanded forward in the coupling direction from the contact leg portion 26, it is capable of making contact with the rear face of the contact plate 12A of the contact step portion 12 of the mounting object portion 10 with a elastic force. According to this embodiment, the contact leg portion 26 is formed integrally with the rear end portion of an extending portion 27 extending backward from the rear end portion of each of both sides of the first connector main body 21.

Figure 9:
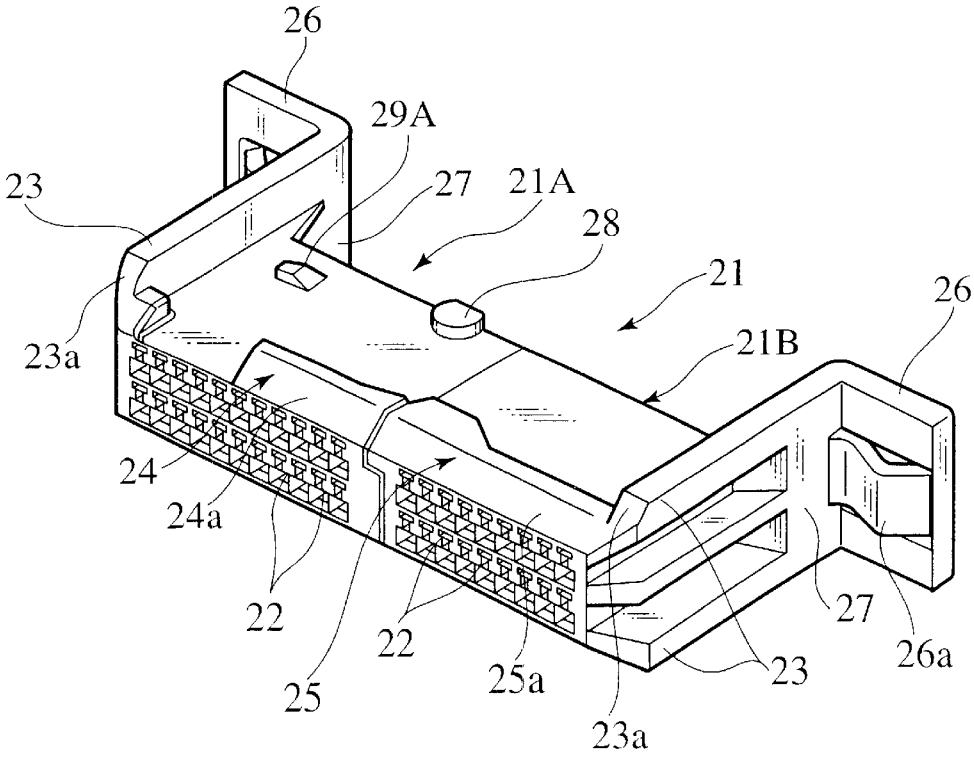
FIG. 9 is a perspective view showing a main body of first connector of the embodiment.
Figure 10:
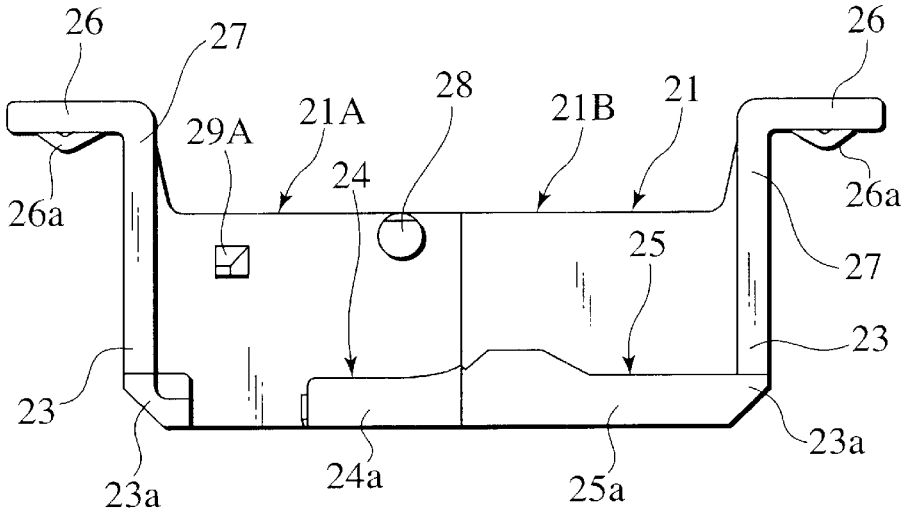
FIG. 10 is a plan view showing the main body of first connector of the embodiment.
Figure 11:
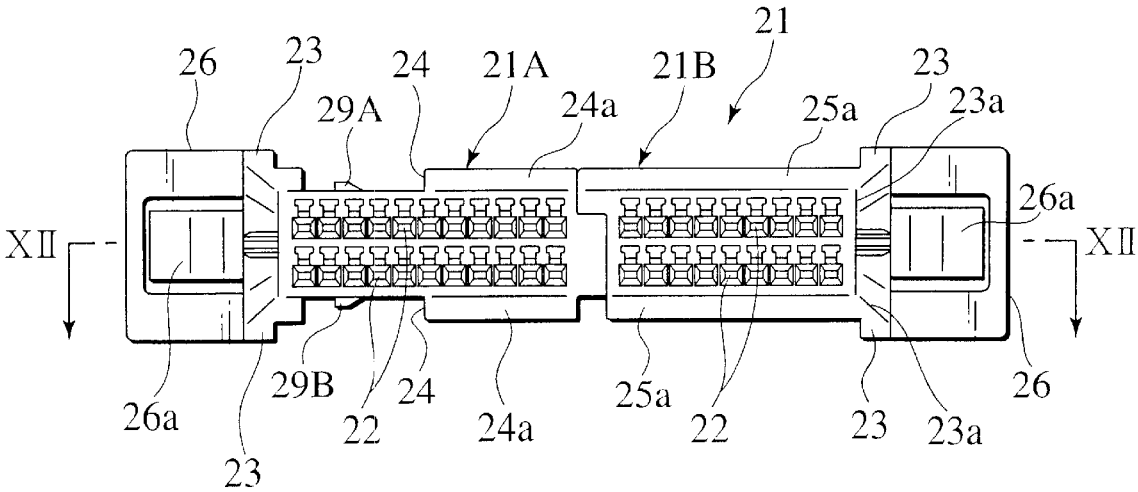
FIG. 11 is a front view showing the main body of first connector of the embodiment.

As shown in FIGS. 9, 10, a rotation supporting shaft 28 is provided protrudingly in the center of the rear portion of each of the upper and lower faces of the first connector main body 21 (corner portion at the rear end of the connector unit 21A) in order to support the engagement lever 30 in a rotatble manner. Further, sideways of the rotation supporting shaft 28 on each of the upper and lower faces of the first connector 21 (connector unit 21A) are provided protrudingly temporarily holding protrusions 29A, 29B for holding the engagement lever 30 supported rotatably by this rotation supporting shaft 28 temporarily.

(Structure of the engagement lever 30)

Next, the structure of the engagement lever 30 will be described. As shown in FIGS. 14 to 19, this engagement lever 30 is comprised of a pair of lever plates 31, 31 parallel to each other and having the same shape and a linking plate portion 32 formed integrally with the lever plates 31, 31 in order to link end portions thereof. This engagement lever 30 is molded integrally using repellent synthetic resin.

Figure 14:
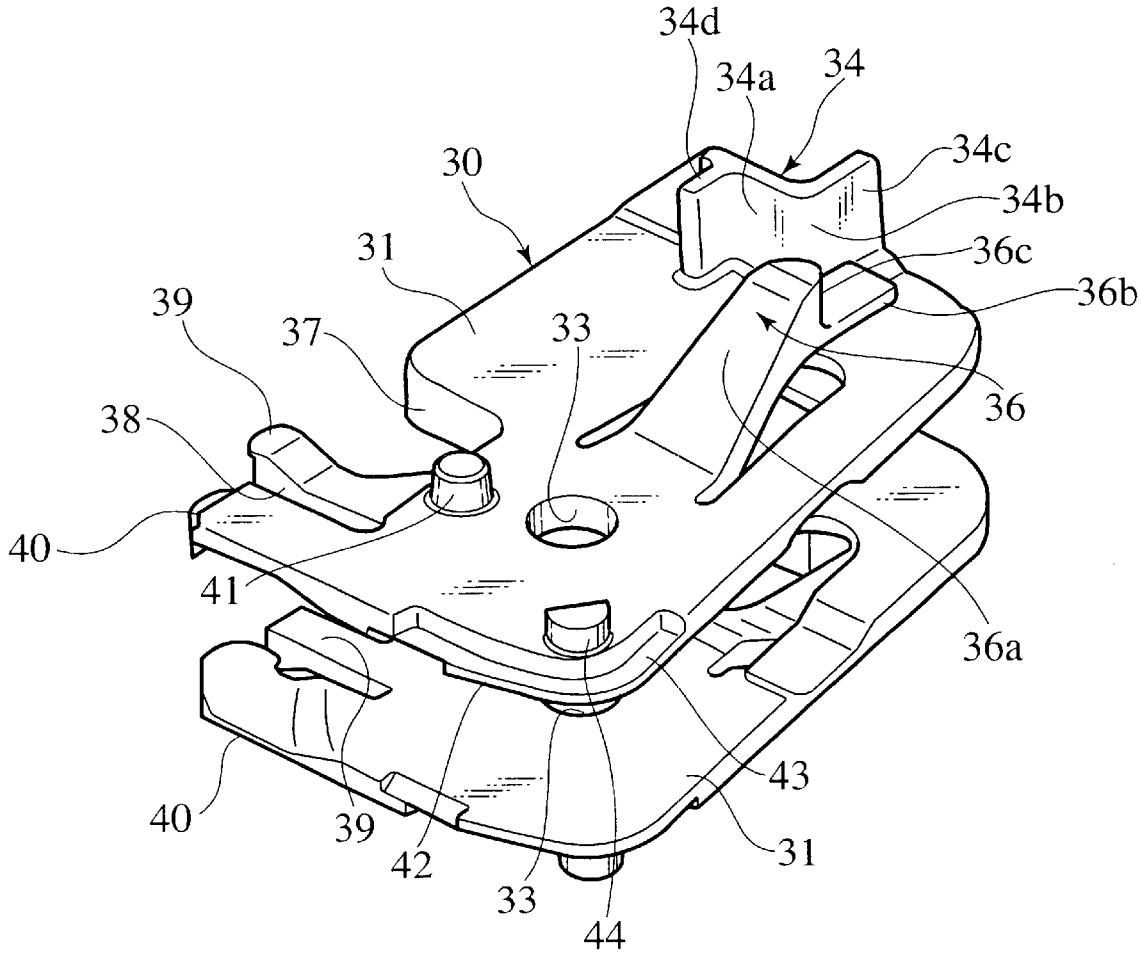
FIG. 14 is a perspective view showing a condition in which the engaging lever of the embodiment is viewed from obliquely front.
Figure 15:
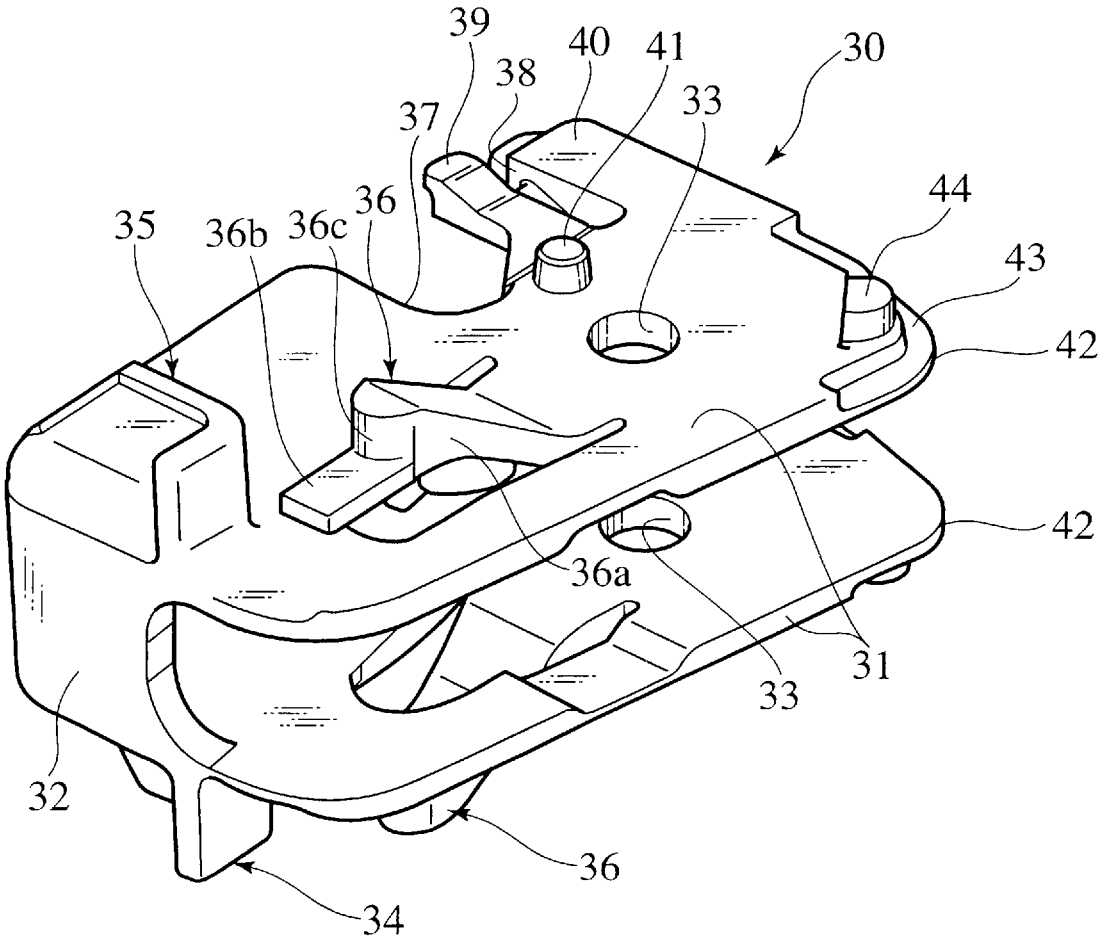
FIG. 15 is a perspective view showing a condition in which the engaging lever of the embodiment is viewed from obliquely backward.
Figure 16:
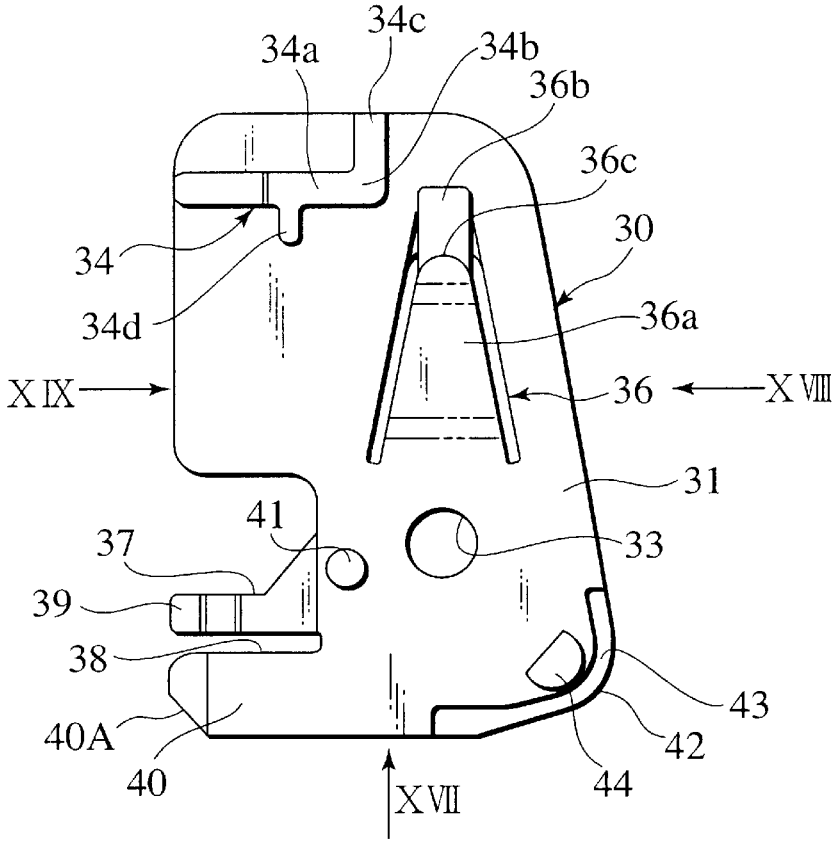
FIG. 16 is a plan view of the engaging lever in the embodiment.
Figure 17:
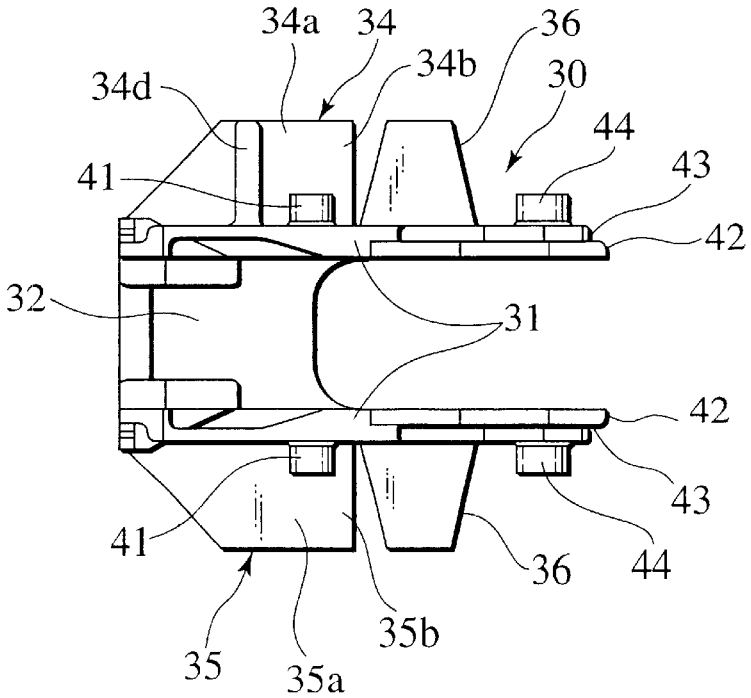
FIG. 17 is a side view of the engaging lever as viewed in the direction of an arrow XVII in FIG. 16.
Figure 18:
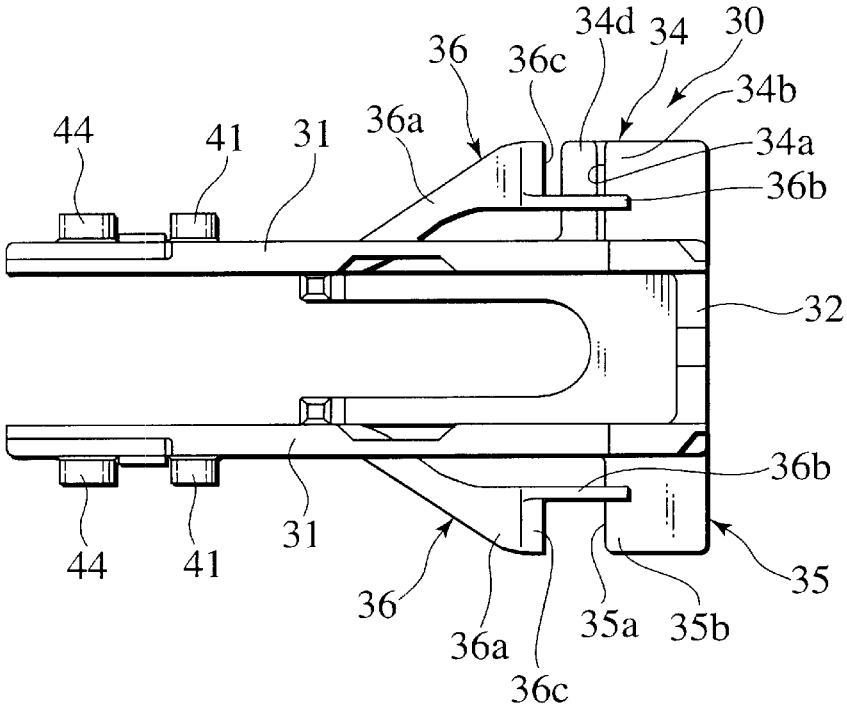
FIG. 18 is a side view of the engaging lever as viewed in the direction of an arrow XVIII of FIG. 16.
Figure 19:
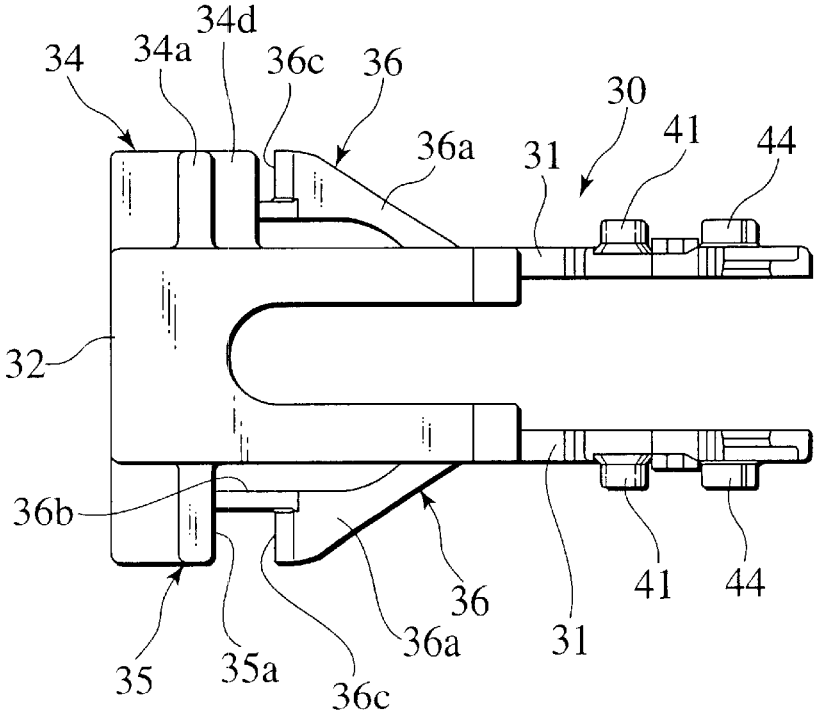
FIG. 19 is a side view of the engaging lever as viewed in the direction of an arrow XIX of FIG. 16.
Figure 20:
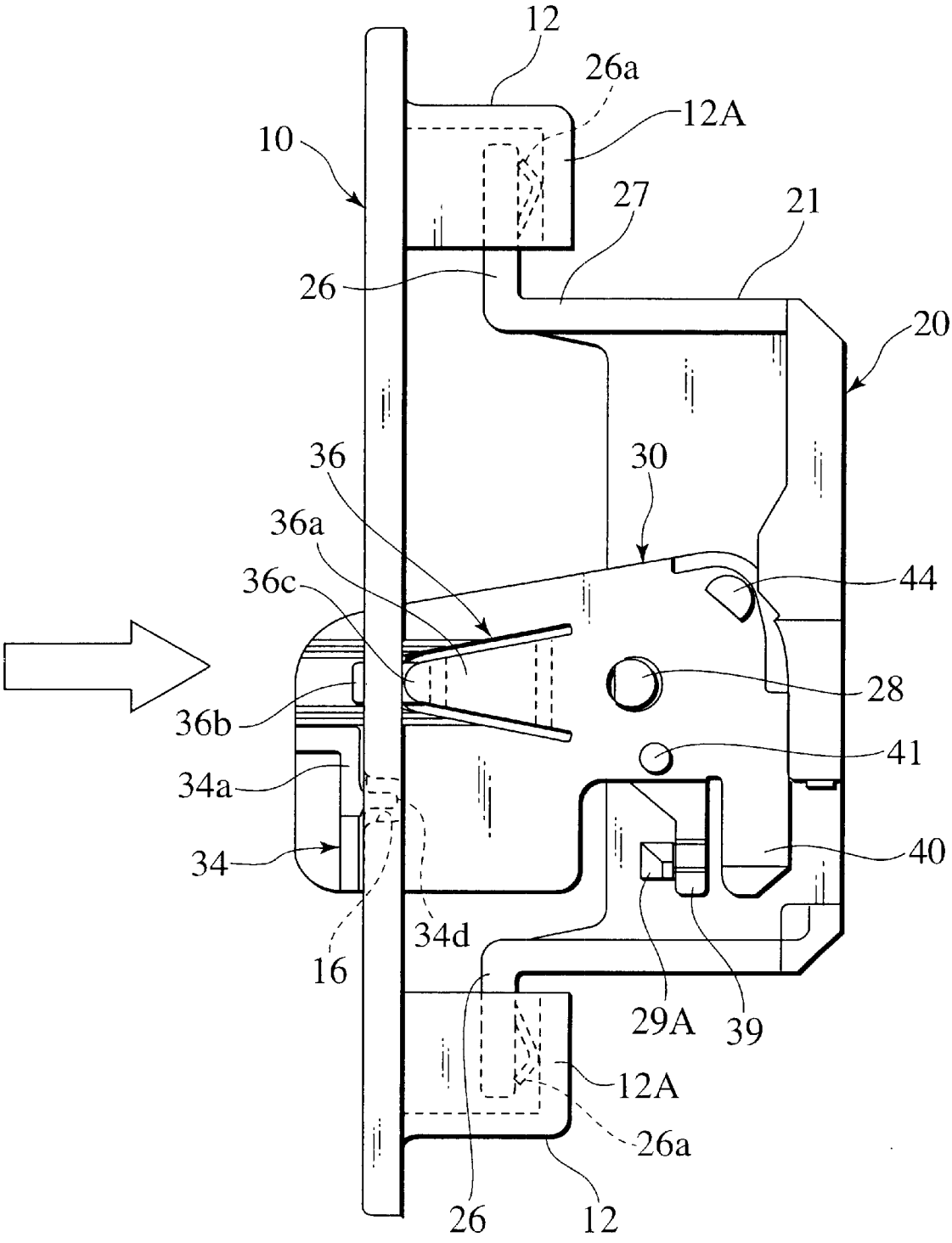
FIG. 20 is a plan view of the supporting structure of a first connector of the embodiment.

FIG. 14 is a perspective view of the engagement lever 30 as viewed from a side opposite to the linking plate 32 and FIG. 15 is a perspective view of the engagement lever 30 as viewed from the side of the linking plate 32. FIG. 16 is a plan view of the engagement lever 30. FIG. 17 is a front view of the engagement lever as viewed in the direction of an arrow XVII of FIG. 16. FIG. 18 is a side view of the engagement lever 30 as viewed in the direction of an arrow XVIII of FIG. 16. FIG. 19 is a side view of the engagement lever 30 as viewed in the direction of an arrow XIX of FIG. 16.

Each of a pair of the lever plates 31, 31 has a shaft hole 33 into which the rotation supporting shaft 28 provided protrudedly on the upper and lower faces of the first connector main body 21 is to be inserted. As shown in FIG. 8, the engagement lever 30 is mounted such that it is capable of rotating with respect to the first connector main body 21 if the rotation supporting shaft 28 is inserted into the shaft hole 33 in the lever plate 31 disposed in each of the upper and lower faces of the first connector main body 21.

The aforementioned linking plate 32 links free ends of the lever plates 31, 31 journaled by this rotation supporting shaft 28. The free ends of these lever plates 31, 31 are set up to be projected backward of a rear end portion of the first connector main body 21 (backward with respect to the coupling direction of the first connector 20).

As shown in FIG. 14, a rear contact protrusion 34 is provided protrudedly on the surface of the free end portion of one lever plate 31 of the engagement lever 30. The other lever plate 31 has a rear contact protrusion 35 provided protrudedly on the surface of the free end portion thereof. As shown in FIG. 14, the rear contact protrusion 34 provided on the one lever plate 31 is formed in L shaped as viewed in plan such that a temporary contact portion 34*a*, a curved contact portion 34*b* and a reinforcement portion 34*c* are continuous and an coupling error preventing rib 34*d* is formed at a predetermined position on the front face of the temporary contact portion 34*a* such that it is protruded.

The coupling error preventing rib 34*d* is formed so as to rise up to the same height as that of the temporary contact portion 34*a* from the lever plate 31. As described later, this coupling error preventing rib 34*d* is set up to be inserted into the coupling error preventing concave portion 16 formed in the mounting object portion 10 when the first connector 20 is held in the mounting object portion 10 temporarily if the mounting object hole 11 adapts to the first connector 20.

The rear contact protrusion 35 provided on the other lever plate 31 is formed in the shape of letter L such that a temporary engagement portion 35*a*, a curved contact portion 35*b* and a reinforcement portion 35*c* are continuous as shown in FIG. 15. Meanwhile, the rear contact protrusion 35 is not provided with the coupling error preventing rib 34*b* unlike the rear contact protrusion 34. Therefore, this fact enables to prevent the first connector 20 from being installed on the mounting object portion 10 if the one lever plate 31 and the other lever plate 31 are installed vertically inversely.

The lever plates 31, of the engagement lever 30 have front engagement arms 36, 36. These front engagement arms 36, 36 are formed so as to be extended toward the free ends of the lever plates 31 from near the shaft holes 33 in the lever plates 31, 31. This front engagement arm 36 is comprised of a flexible arm portion 36*a* whose end portion is continuous integrally with the lever plate 31 near the shaft hole 33 and a centering tongue portion (hole contact portion) 36*b* which is extended toward the free end of the lever plate 31 from a bottom portion of the free end of the flexible arm portion 36*a*. The flexible arm portion 36*a* and the centering tongue portion 36*b* are formed integrally using synthetic resin like the lever plate 31.

The aforementioned flexible arm portion 36*a* has a relative thickness and is formed obliquely such that it leaves the lever plate 31 gradually as it goes toward the free end and the thickness thereof is increased gradually as it goes toward the free end. The flexible arm portion 36*a* has elasticity in the directions of the front and rear faces of the lever plate 31. A free end of the flexible arm portion 36*a* acts as a front contact portion 36*c* which provides a step to the centering tongue portion 36*b* extended from that free end. The centering tongue portions 36*b*, 36*b* of the lever plates 31, 31 opposing each other are formed substantially parallel to each other. In a condition before installing the connector 20 to the mounting object portion 10, a distance between these centering tongue portions 36*b* and 36*b* is set up longer than the distance between the edge portions of the lever rotation concave portions 13, 13 in the mounting object portion 10. Thus, when the first connector 20 is mounted in the mounting object portion 10 temporarily, the first connector 20 is held at neutral positions up and down of the mounting object portion 10 with the elastic force of the centering tongue portions 36*b*, 36*b*.

When the first connector 20 is installed on the mounting object portion 10, this front contact portion 36*c* comes into contact with a front face of the mounting object portion 10. Then, when the front contact portion 36*c* makes in contact with the front face of the mounting object portion 10, if the front face of the mounting object portion 10 is viewed from the front, the front contact portion 36*c* can be seen forward of the lever rotation concave portion 13. This indicates that the first connector 20 is engaged with the mounting object portion 10 temporarily.

The front contact portion 36*c* acts as a power point when engaging the first connector 20 with the second connector 50 in a condition that it is in contact with the front face of the mounting object portion 10.

In a region sideway of a line connecting the front contact portion 36*c* with the shaft hole 33 of each of outside faces of the lever plates 31, 31 opposing each other is formed temporary installation cutout portions 37, 38 via a temporary holding protrusion 39 by cutting out from the periphery of the lever plate 31 toward the shaft hole 33, such that it is located at a position substantially at right angle to the front contact portion 36*c* with respect to the shaft hole 33. Further, a protective protrusion 40 is formed opposite to the temporary holding protrusion 39 across the temporary installation cutout portion 38.

The temporary installation cutout portions 37, 37 formed in the lever plates 31, 31 are concave portions in which the temporary holding protrusions 29A, 29B formed on the first connector main body 21 are disposed when the first connector main body 21 is installed on the engagement lever 30 temporarily. The temporary holding protrusion 39 is formed when the temporary installation cutout portions 37, 38 are formed and has flexibility and elasticity in the direction of the front and rear faces of the lever plate 31. As described later, when coupling the first connector 20 with the second connector 50, this temporary holding protrusion 39 releases temporary holding condition of the first connector main body 21 and the engagement lever 30 by surpassing the temporary holding protrusion 29A.

As shown in FIG. 16, the protective protrusion 40 is disposed at a corner on the front side of the substantially rectangular lever plate 31 while a jig guide tapered face 40A is formed at the front corner position. This jig guide tapered face 40A functions as a guide face for an installation jig for use when installing the engagement lever 30 onto the first connector main body 21.

A lever rotation protrusion 41, which comes into contact with the second connector 50 when the first connector is coupled with the second connector 50, is provided protrudedly in the vicinity of the temporary holding protrusion 39 of the lever plate 31. This lever rotation protrusion 41 functions as an action point for transmitting a rotation force for rotating the engagement lever 30 with respect to the shaft hole 33 and the rotation supporting shaft 28 when it is pressed toward the second connector 50.

A rounded face 42 of substantially a quarter of the circumference is formed at the other corner portion on the front side of the lever plate 31. A peripheral step portion 43 having a smaller thickness than that of the lever plate 31 is formed in a predetermined range along the edge portion in which this rounded face 42 is formed. When the engagement lever 30 is mounted on the first connector main body 21, this peripheral step portion 43 is inserted into the guide concave portion 24*a* formed in the rear face of the stopper 24 of the first connector 21. If the peripheral step portion 43 is inserted into the guide concave portion 24*a* of the stopper 24, the lever plate 31 is blocked from being raised up from the first connector main body 21 in order to prevent the engagement lever 30 from being released from the first connector main body 21.

Although the lever plate 31 is capable of moving (rotating) along the guide concave portion 24*a* in the range in which the peripheral step portion 43 is formed, the moving (rotation) range is specified by a contact between the stopper 24 and the front edge portion of the lever plate 31. More specifically, as shown in FIGS. 2, 3, and 8, the temporary holding protrusions 29A, 29B provided protrudedly on the first connector main body 21 are located in the temporary installation cutout portion 37 formed in the lever plate 31 of the engagement lever 30 and further, as shown in FIG. 8, the engagement lever 30 is allowed to rotate by a predetermined angle in the direction of an arrow d from a position where the temporary protrusion 29A, 29B make contact with the temporary holding protrusion 39.

Further, an contact protrusion 44 is provided protrudedly at the other corner on the front side of the lever plate 31. When coupling the first connector 20 with the second connector 50, this contact protrusion 44 exerts an action for bringing the second connector 50 to the side of the first connector 20 due to an action of a lever accompanied by a rotation of the engagement lever 30.

This engagement lever 30 is installed onto the first connector main body 21 with an installation jig. At this time, as shown in FIG. 16, the jig guide tapered face 40A of the protective protrusion 40 formed at the corner of the lever plate of the engagement lever 30 guides the engagement lever 30 into an installation jig. Consequently, the engagement lever 30 is installed onto the first connector main body 21, so that the first connector 20 is produced.

(Structure of the second connector 50)

Next, the structure of the second connector 50 will be described with reference to FIGS. 2, 3. The second connector 50 is substantially rectangular parallelepiped and has a plurality of male terminal metals which engage with female terminal metals (not shown) accommodated in the terminal accommodating chamber 22 of the first connector 20 when the first connector 20 is inserted into the second connector 50. In both sides of upper, lower inner walls of the second connector 50 are formed guide groove portions 52, 52 for guiding the guide protrusions 23, 23 formed on both sides of the upper and lower faces of the first connector main body 21.

The upper, lower inner wall faces of the second connector 50 have engagement receiving portions 53 which are formed on the engagement lever 30 mounted on the first connector 20 and engage the contact protrusion 44. An engagement groove portion 54 for guiding the contact protrusion 44 provided protrudedly on the engagement lever 30 installed temporarily is formed in a side portion of this engagement receiving portion 53. The contact protrusion 44 inserted through this engagement groove portion 54 is moved along the peripheral face directed inward of the second connector 50 on the engagement receiving portion 53 accompanied by a rotation of the engagement lever 30 generated when the first connector 20 engages the second connector 50. At this time, the contact protrusion 44 has an action for pressing the engagement receiving portion 53 toward the first connector 20 by an action of a lever generated when the engagement lever 30 is rotated by a pressure force of the second connector 50.

Further, the front end face of the engagement receiving portion 53 is set up to come into contact with the lever rotation protrusion 41 provided protrudedly on the engagement lever 30. Thus, if the second connector 50 is pressed to the first connector 20, the engagement receiving portion 53 presses the lever rotation protrusion 41 so that the engagement lever 30 is rotated with respect to the rotation supporting shaft 28.

(Procedure for, operation and action of installing the first connector 20 temporarily)

Next, the procedure for and operation and action of installing the first connector 20 of this embodiment in the mounting object portion 10 temporarily will be described.

First, the first connector 20 is inserted into the mounting object hole 11 in the mounting object portion 11 shown in FIG. 4 from the rear side (direction of an arrow of FIG. 20) in which the contact step portion 12 is not provided. At this time, the engagement lever 30 mounted on the first connector 20 is installed temporarily on the first connector 21 as shown in FIG. 8 so that it is not deflected during insertion into the mounting object hole 11 or not made free (freely rotatable) of the first connector main body 21.

More specifically, the rear face of the contact spring portion 26*a* of the engagement lever 30 makes contact with the temporary holding protrusions 29A, 29B provided on the upper and lower faces of the first connector main body 21. Additionally, the front side face of the protective protrusion 40 of the engagement lever 30 makes contact with the rear side face of the stopper 24 formed on each of up and down of the front end portion of the first connector main body 21. As a result, the engagement lever 30 is blocked from being rotated in any direction of clockwise and counterclockwise with the rotation supporting shaft 28 as a rotation shaft or in a temporary installation condition.

The first connector 20 having the temporarily installed engagement lever 30 is inserted into the mounting object hole 11 from the front end portion of the first connector main body 21. As the first connector 20 is inserted into the mounting object hole 11, an outside slope of the flexible arm portion 36*a* of the front engagement arm 36 makes a sliding contact with an edge portion of the lever rotation concave portion 3 of the mounting object hole 11.

If the first connector 20 is inserted further, the upper and lower flexible arm portions 36*a*, 36*a* are deformed (distorted) in a direction in which a distance between the flexible arm portions 36*a* and 36*a* is decreased with an accumulated elastic force, because the distance between the outside faces of the flexible arm portions 36*a*, 36*a* is longer than the distance between the edge portions of the upper and lower lever rotation concave portions 13 in the mounting object hole 11.

If the front contact portion 36*c* of the front contact arm 36 passes the edge portion of the lever rotation concave portion 13 as the first connector 20 is advanced forward in the mounting object hole 11, the flexible arm portions 36*a*, 36*a* act to be restored in a direction that they leaves each other due to the accumulated elastic force because action for suppressing the flexible arm portions 36*a*, 36*a* vanishes.

Consequently, the centering tongue portions 36*b*, 36*b* of the front contact arms 36 make contact with the edge portion of the lever rotation concave portions 13. At this time, the flexible arm portions 36*a*, 36*a* are not restored completely and kept with some amount of the elastic force accumulated. Thus, the first connector main body 21 is held (centered) in the center in the vertical direction of the mounting object hole 11 by the centering tongue portions 36*b*, 36*b* of the engagement lever 30. At this time, the temporary contact portions 34*a*, 35*a* of the rear contact protrusions 34, 35 formed on the lever plates 31 of the engagement lever 30 make contact with the rear face (rear face on the edge portion of the lever rotation concave portion 13) of the mounting object portion 10.

Further, at this time, the contact spring portions 26*a* of the contact leg portions 26 make contact with the rear faces of the contact plate 12A of the contact step portion 12 of the mounting object portion 10 with elastic force. Consequently, the first connector 20 is installed onto the mounting object portion 10 temporarily.

If the first connector 20 is installed on the mounting object portion 10 temporarily, the flexible arm portions 36*a,* 36*a* can be seen when the first connector 20 and the mounting object portion 10 are viewed from the front of the first connector 20, thereby making it possible to recognized that the temporary installation has been achieved. Therefore, there is no fear of neglecting that the first connector 20 is not installed on the mounting object portion 10 temporarily, thereby ensuring that the first connector 20 is coupled with the second connector 50.

Figure 21:
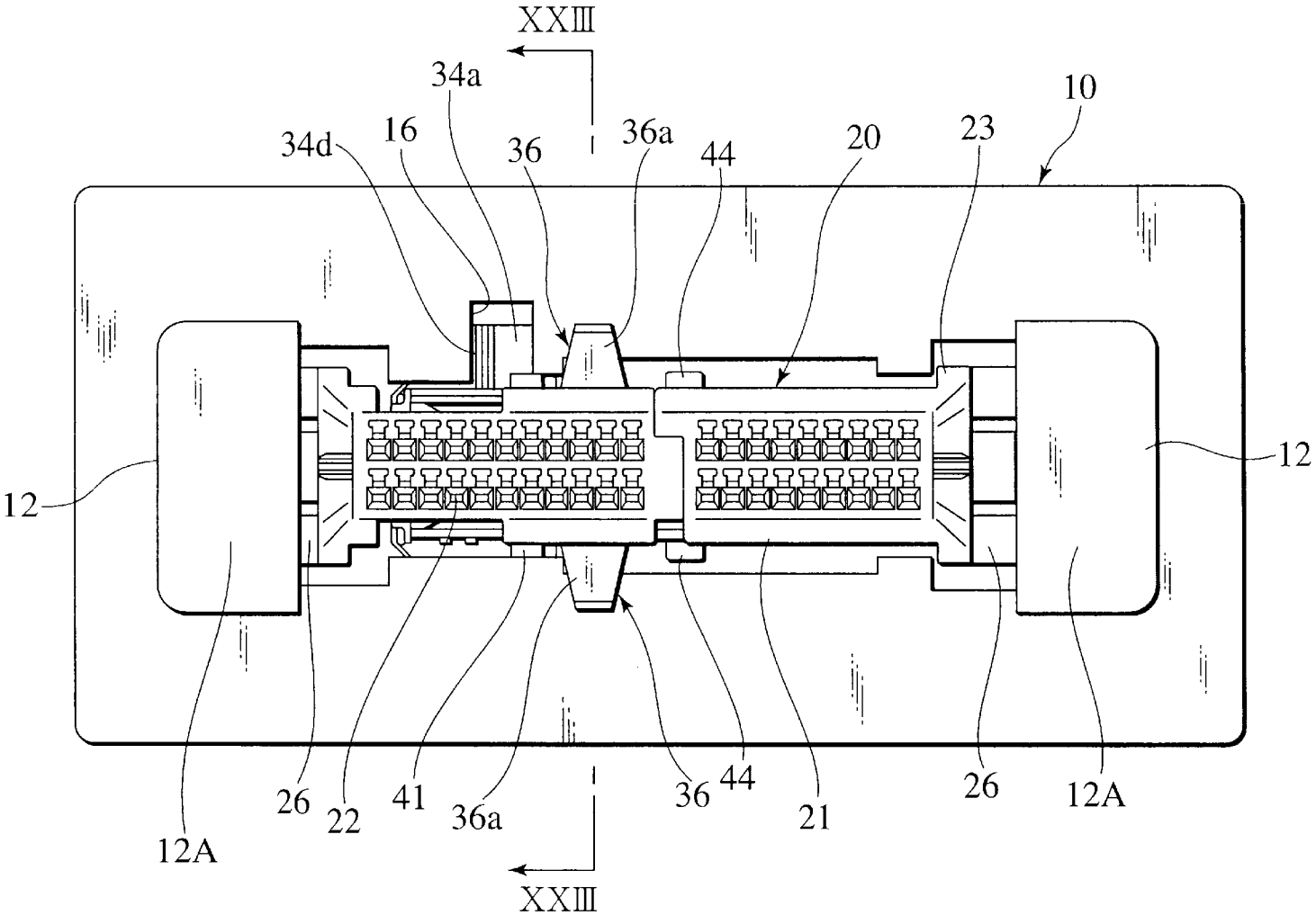
FIG. 21 is a front view of the supporting structure of a first connector of the embodiment.
Figure 22:
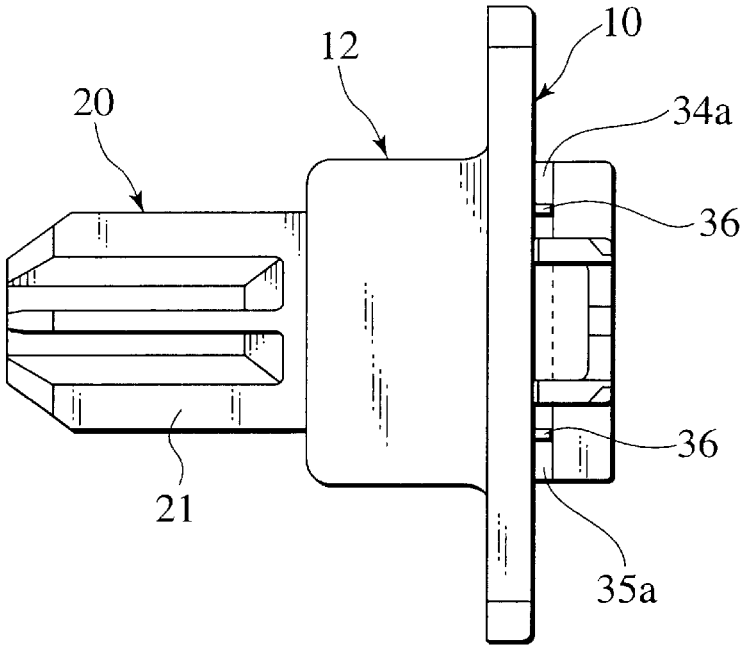
FIG. 22 is a side view of the supporting structure of a first connector of the embodiment.
Figure 23:
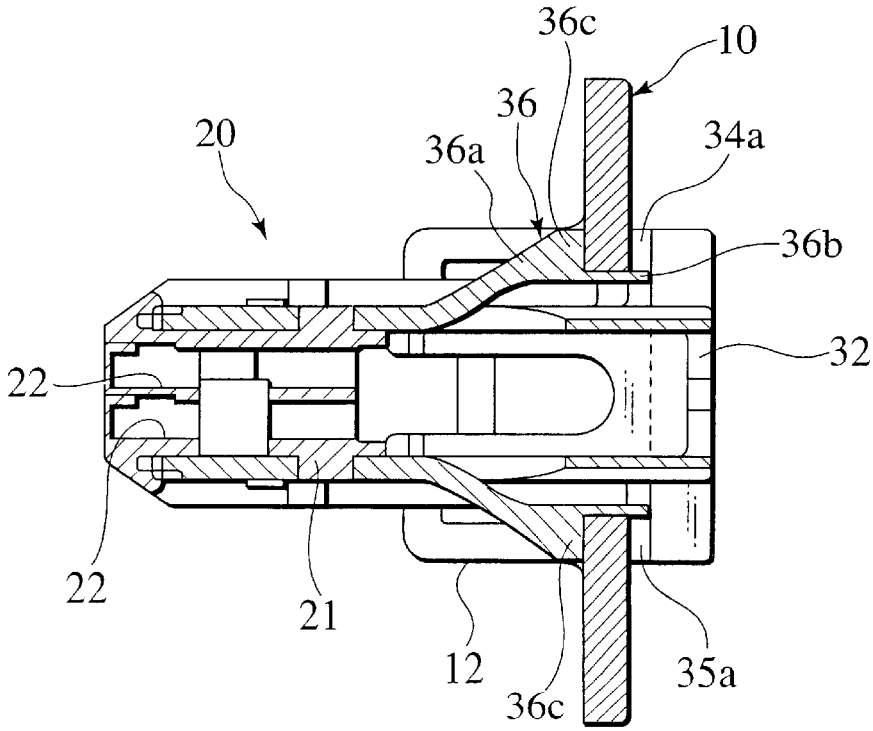
FIG. 23 is a sectional view taken along the lines XXIII—XXIII of FIG. 21.

FIG. 21 is a front view of the first connector 20 coupled with the mounting object portion 10 temporarily as viewed from the front thereof. As shown in FIG. 21, in such a temporary installation condition, the flexible arm portions 36*a* can be seen from the front thereby making it possible to recognize that the temporary installation has been achieved. FIG. 22 is a side view of the first connector 20 mounted on the mounting object portion 10 temporarily. As shown in FIG. 23 showing the sectional view taken along the lines XXIII-XIII of FIG. 21, the mounting object portion 10 is nipped by the front contact portions 36*c,* 36*c* of the front contact arm 36 and the temporary contact portions 34*a,* 35*a* of the rear contact protrusions 34, 35. Consequently, the first connector 20 is installed on the mounting object portion 10 temporarily.

Further, the installation error preventing rib 34*d* formed on the rear contact protrusion 34 is accommodated in the installation error preventing concave portion 16 formed in the mounting object portion 10 (see FIGS. 2, 3, 20, 21). Because the installation error preventing concave portion 16 is formed only in the upper edge of the mounting object hole 11, if it is intended to install the first connector 20 inversely by mistake, the installation error preventing rib 34*d* comes into contact with a rear face on the lower edge of the mounting object hole 11 so that invasion of the first connector 20 is blocked. Thus, such an installation error can be prevented. Further, if it is intended to install a connector based on other standard inadaptable for the mounting object portion 10, this structure can block such an installation error.

To couple the second connector with the first connector installed temporarily on the mounting object portion 10, the first connector 20 is fit to an opening in the front end of the second connector 50 in a well known manner. Due to this fitting, the lever rotation protrusion 41 of the engagement lever 30 is pressed by the front end face of the engagement receiving portion 53 of the second connector 50 so as to rotate the engagement lever 30. Consequently, the temporary holding protrusions 39, 39, which are kept in contact with the temporary holding protrusions 29A, 29B, surpass those temporary holding protrusions 29A, 29B so that the temporary holding of the engagement lever 30 by the first connector main body 21 is released. Further, if the second connector 50 is pressed toward the first connector 20, the front contact portion 36*c* slides on the front face of the mounting object portion 10 and moves in the rotating direction of the engagement lever 30.

Accompanied by this, the rear contact protrusions 34, 35 move along the rear face of the mounting object portion 10. When the rear contact protrusions 34, 35 move in this way, the curved contact portions 34*b,* 35*b* are always kept in contact with the rear face of the mounting object portion 10. Thus, the first connector 20 never leaves the mounting object portion 10, so that it is kept in contact despite a rotation of the engagement lever 30.

Accompanied by a rotation of the engagement lever 30, the engagement protrusion 44 of the engagement lever 30 moves along the peripheral face of the engagement receiving portion 53 of the second connector 50 so as to press the engagement receiving portion 53 toward the first connector 20. As a result, due to the action of the lever, the second connector 50 and the first connector 20 are coupled with each other at a small pressing force.

The preferred embodiments of the present invention have been described above. It should not be understood that a description and drawings of part of disclosure of the embodiments restrict the present invention. Various other modifications and application technologies may be evident to those skilled in the art from such a disclosure.

For example, although according to the above-described embodiments, the first connector 20 accommodates the female terminal metals while the second connector 50 accommodates the male terminal metals, an inverse structure may be applied. Further, although according to the above-described embodiments, a single engagement lever 30 is provided on the first connector 20, it is permissible to provide the engagement lever on each of the right and left sides.

What is claimed is:

1. A connector supporting mechanism comprising:

a connector main body;

a pair of lever plates disposed on both sides of the connector main body;

a linking portion for linking the lever plates integrally;

an engagement lever constituted of the linking portion and the lever plates;

a connector in which the engagement lever is mounted on the connector main body rotatably;

a plate-like mounting object portion for supporting the connector such that it is inserted into a mounting object hole;

front contact portions which are provided on the lever plate portion and come into contact with a front face of the mounting object portion;

front contact arms provided on the front contact portion and having elasticity;

hole contact portions provided at a front end portion of the front contact arm; and rear contact portions coming into contact with a rear face of the mounting object portion, wherein when the connector is inserted into the mounting object hole, the hole contact portions come into contact with an inner peripheral face of the mounting object hole with pressure so as to obtain the center in the vertical direction of the connector main body.

2. A connector supporting mechanism according to claim 1 wherein the front contact portion has a thickness allowing itself to be seen from the front of the mounting object portion and the hole contact portion and the front contact portion are formed with a step.

3. A connector supporting mechanism according to claim 1 wherein a distance between the hole contact portions formed on the front contact arms of the pair of the lever plates is longer than a vertical dimension of the mounting object hole before the connector is installed into the mounting object portion.

4. A connector supporting mechanism according to claim 1 wherein the front contact arm is inclined such that it leaves the lever plate gradually.

5. A connector supporting mechanism according to claim 1 wherein the pair of the lever plates, only one lever plate has a rib while the mounting object portion has a concave portion which engages the rib of the lever plate.

6. A connector supporting mechanism according to claim 1 wherein the mounting object portion contains a concave portion that allows the engagement lever to rotate.

7. A connector supporting mechanism according to claim 6 wherein the connector main body includes a stopper for restricting a rotation of the engagement lever in an opposite direction.

8. A connector supporting mechanism according to claim 7 wherein the lever plate further has a rounded face of substantially a quarter of a circumference provided at a corner in a fitting direction relative to the connector main body, while a stepped portion provided on the rounded face is inserted into a guide concave portion provided opposite to the fitting direction to the mounting object portion, in the stopper.

* * * * *